United States Patent [19]

Chi et al.

[11] Patent Number: 4,913,995

[45] Date of Patent: Apr. 3, 1990

[54] AMORPHOUS SILICON ELECTROPHOTOGRAPHIC PHOTORECEPTOR WITH AN INTERMEDIATE GRADIENT LAYER AND ITS METHOD OF PREPARATION

[75] Inventors: Dong-zhi Chi; Ru-guang Cheng, both of Shanghai, China

[73] Assignee: Guo Jing Kun, Shanghai Institute of Ceramics, Shanghai, China

[21] Appl. No.: 283,922

[22] Filed: Dec. 13, 1988

[30] Foreign Application Priority Data

Dec. 14, 1987 [CN] China ..... 87101140.9

[51] Int. Cl.[4] ..... G03G 5/14

[52] U.S. Cl. ..... 430/58; 430/86

[58] Field of Search ..... 430/57, 58, 85, 86

[56] References Cited

U.S. PATENT DOCUMENTS 4,600,670 7/1986 Yamazaki ..... 430/57

*Primary Examiner*—J. David Welsh

[57] ABSTRACT

An amorphous silicon function separation type electrophotographic photoreceptor is disclosed having thin layers, wherein an intermediate layer provides the photoreceptor with high surface potential and low residual potential for positive and negative charging. The intermediate layer lies between a large band gap a-Si alloy transport layer and an a-Si:H photosensitive layer.

15 Claims, 2 Drawing Sheets

AMORPHOUS SILICON ELECTROPHOTOGRAPHIC PHOTORECEPTOR WITH AN INTERMEDIATE GRADIENT LAYER AND ITS METHOD OF PREPARATION

FIELD OF THE INVENTION

The present invention relates to a new kind of function separation type photoreceptor, and more particularly to amorphous silicon and amorphous silicon alloys function separation type photoreceptor with an intermediate gradient layer and a process for preparing the same.

BACKGROUND OF THE INVENTION

It is well known that copying techniques is a modern method for document processing. The technique is concerned with a special process through which one can obtain hand copies of different kinds of imformation. Among the different types of copying techniques, electrophotographic technique has its great advantages because of its high photosensitivity, its convenience to store and access automatically, and the use of common recording materials, so that it is now widely used in modern office appliances.

Amorphous silicon has great advantages for use as a photoreceptor material characterized by its high photosensitivity, strong mechanical surface hardness, excellent thermal and humid stability and non-pollution to the environment. Particulary, because of its high photosensitivity in near IR wavelength, amorphous silicon photoreceptor has shown its high potential in laser printer and intellegent word processor applications. Amorphous silicon photoreceptors can be divided into two categories according to their device structures:

(1) Single layer amorphous silicon photoreceptor or a—Si photoreceptor with a blocking and a passivation layers. In this type of photoreceptor, a—Si:H acts as both photosensitive layers and transport layer. (JP Publication 8651154, Mar. 13, 1986) The introduction of blocking and passivation layers only decreases the injection of carriers from back contact and free surface, but which does not change the functions of amorphous silicon.

(2) Function seperation type a—Si:H photoreceptor. In this type of photoreceptor the existance of high resistant transport layer such as a—SiCx:H or $SiO_2$ makes the photoreceptor posess sufficient surface potential. The existance of a—Si:H photosensitive layer makes the photoreceptor posess excellent photosensitivity.

Owing to the limitation of the intrinsic properties of a—Si:H and their structural properties, both kinds of photoreceptors have their own disadvantages. Because the maximum sustaining electrical field strength of a—Si:H is about 10-50 V/$\mu$, the thicknesses of above photoreceptors must exceed 10-60 um in order to obtain the necessary surface potential. The time needed to fabricate a photoreceptor with the thickness of 10-60 um is very long (generally it needs about 10-100 hours by the ordinary plasma enhanced CVD process). In the case of the photoreceptors with blocking layer structure, n type or p type a—Si:H is used as blocking layer, which is necessary to decrease the residual potential. Since the n-type or p-type a—Si:H blocking layer can only block one kind of carriers, alternatively it cannot sustain sufficient surface potential to another type of discharge condition. In the function separation type of photoreceptor, there is a sharp heterostructure interface between the photosensitive layer and the transport layer. This sharp heterointerface is a potential barrier to at least one kind of carriers, thus this type of carriers cannot effectively inject into transport layer from photosensitive layer, which results in poor photosensitivity in the same sign discharge condition. Because of the existance of the interface states, the residual potential of this type photoreceptor is relatively high.

In conventional fabrication methods of single layer and multilayers amorphous silicon photoreceptors, usually $SiH_4$, $CH_4$, $SiX_4$ and $CX_4$ (X means halogen) are used as raw materials for the fabrication of different function layers of a—Si:H photoreceptors. Aluminium substrate or drum is put in a rf or dc plasma discharge deposition system. The system is evacuated to high vacuum, then small amount of different gases is introduced and maintained at a low gas pressure. The temperature of Al substrate or drum is maintained about 180°-350° C. When rf power is supplied to capaticitance composed of cathode and anode, the plasma formed causing the decomposition of gas materials, thus different function layers are deposited depending on the gaseous composition. In such way, Al substrate or drum is placed on the anode, but the deposition rate for device grade films is rather low, therefore, the time needed to fabricate a photoreceptor is consequently quite long.

OBJECTS OF THE INVENTION

In view of the foregoing, it is the main object of this invention to provide a new kind amorphous silicon function separation type photoreceptor which is rather thin in thickness of the layers so that the time needed to fabricate the photoreceptor is consequently quite short and thus the manufacturing cost is decreased. The thin film thickness will introduce less defects which alternatively will raise the performence of the film.

Another object of the present invention is to provide a rather thin amorphous silicon function separation type photoreceptor with an intermediate layer structure that the photoreceptor posesses sufficient high surface potential, rather low residual potential and excellent photosensitivity for both positive and negative discharges during electrophotography.

A further object of the present invention is to provide a process for fabrication of the same.

BRIEF DESCRIPTION OF DRAWINGS

These and other objects as well as advantages of the present invention will become clear by the following description of preferred examples of the present invention with reference to the accompanying drawings, wherein.

SUMMARY OF THE INVENTION

In accordance with the present invention, there is provided an amorphous silicon function seperation photoreceptor having a sandwich type structure wherein amorphous silicon alloy with larger optical gap, such as a—SiNx:H or a—SiCx:H is employed as transport layer so that the sustaining electrical field of photoreceptor is increased from 10–50 V/μ of conventional single a—Si:H to 100 V/μ or even larger. Thus, the photoreceptor with such kind of transport layer can sustain sufficient surface potential, for example, the surface potential of photoreceptor with a total films thickness of about 3.5 um could reach 300 V. Therefor, the time needed for the fabrication of the photoreceptor can be greatly reduced, such as from 10–100 hours to 3 hours or less, consequently raw materials and energy conoumption are relevantly reduced.

In accordance with the process provided in the present invention, the photoreceptor is placed on and connected to the cathode, so the deposition rate of the photoreceptor can be further increased by two times and the consumption of raw material gases can be reduced, which resulting the reduction of the manufacturing cost of the photoreceptor.

Furthermore, in the sandwich type structure of the present invention an intermediate gradient layer introduced between the transport layer of amorphous silicon alloy with large optical gap and the a—Si:H photosensitive layer will diminish the interfacial barrier both for holes and electrons and decrease the density of interfacial trap states so that photocarriers can inject freely from a—Si:H photosensitive layer into the transport layer. This characteristic makes the photoreceptor possess excellent photosensitivity both for positive and negative discharge and low residual potential, such as less than 20 V.

In the process provided by the present invention for manufacturing the photoreceptor with sandwich type structure having above mentined characteristics, the layers are deposited using either one of the following processes:

(1) Plasma enhanced CVD (PECVD)
(2) Photo-CVD
(3) Low pressure CVD (LPCVD)
(4) Microwave plasma CVD
(5) Reactive sputtering
(6) Reactive PVD
(7) magnetron sputtering plus post hydrogenation

DESCRIPTION OF THE PREFERRED EMBODIMENT

Figure 1:
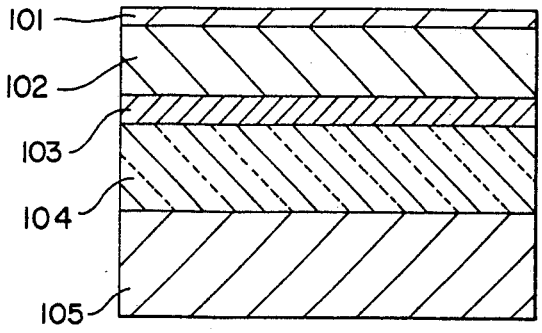
FIG. 1 is the sectional view showing the structure of the photoreceptor provided by the present invention.

Referring now to FIG. 1, there is illustrated an embodiment of the photoreceptor provided by the present invention in the form of a sectional view comprising Layer 101 is a surface passivation layer or surface protective layer which is deposited and selected from the group consisting of a—SiNx:H, a—SiCx:H, a—C:F:H and a—C:H, wherein x, the atomic ratio of N or C to Si:0.4–1.33, represents the same value in the following text. In the absence of the surface passivation layer, the photoreceptor provided by the invention will perform the same function and effects.

Eopt (optical gap) of layer 101=2.0 ev.

Its thickness $d_{101}$ must fulfill the requirement of:

$$(1-\exp(-d_{101}\alpha(\lambda)))=8.5$$

Where α is the optical absorption cofficient at wavelength (λ)=4500 Å.

Layer 102 is a—Si:H photosensitive layer either intrinsic or compensated by adding trace amount of boron.

Its optical gap Eopt is within 1.6–1.8 ev.

Activation energy Ea≧0.75 ev.

Thickness $d_{102}$≧1 μm

Layer 103 is an intermediate gradient layer. The ratio of N/Si or C/Si in this intermediate gradient layer varies from that of transport layer to zero.

Thickness $d_{103}$≧0.1 μm

Layer 104 is a—SiN:H or a—SiCx:H transport layer.

Its Eopt≧2.1 ev.

Ea≧0.85 ev.

d≧2 μm.

Wherein x, the atomic ratio of N or C to Si:0.4–1.33.

105 is metal substrate or drum such as Aluminium.

The layers of the photoreceptor can be prepared in either one of the processes including Plasma enhanced CVD (PECVD) or rf or dc glow discharge plasma deposition

| | |
|---|---|
| Photo - CVD | |
| Low pressure CVD | (LPCVD) |
| Microwave plasma CVD | |
| Reactive sputtering | |
| Reactive PVD | |

Magnetron sputtering plus post hydrogenation, etc.

Figure 2:
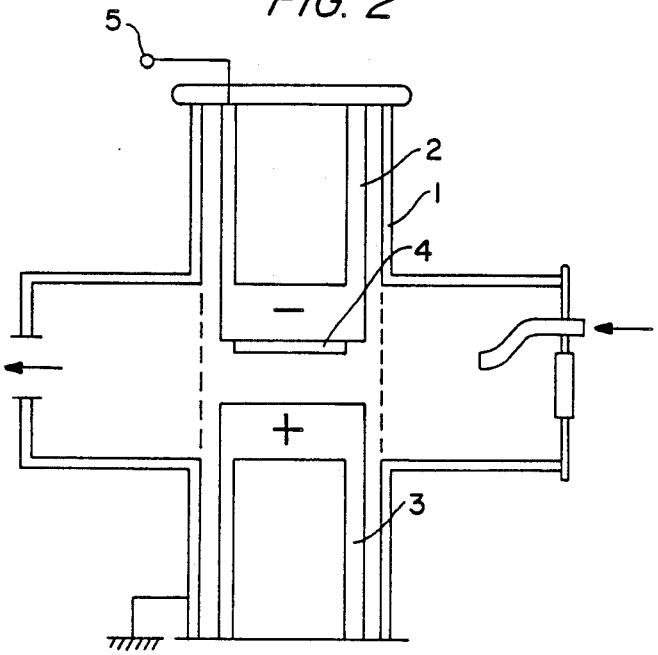
FIG. 2 is the schematic diagram of Plasma CVD for fabricating the photoreceptor provided by the present invention, wherein (1) refers to deposition chamber, (2) cathode, (3) anode, (4) aluminium substrate, (5) power source, (6) . . . expresses metallic mesh screen, (7) "←" expresses the direction of the gas flow.

FIG. 2 shows an embodiment of depositing the layers of the photoreceptor provided by the present invention in a plasma enhanced CVD process using plate as an example.

In FIG. 2, deposition chamber (1) is evacuated to a prevacuum of 10 torr, wherein cathode (2) is expressed as (−), while anode (3) is expressed as (+) and the power source is expressed as (5). (6) . . . expresses metallic mesh screen. (7)"←" expresses the direction of the gas flow.

Aluminum substrate (4) is placed on the cathode (2).

Preparation of layer 101—$SiH_4$, $H_2$ and $NH_3$ (or $CH_4$) gases are premixed and introduced into the deposition chamber. The ratio of $NH_3$ (or $CH_4$) gas flow rate to SiH gas flow rate is 5–7 (volume ratio). Layer 101 can be optionally used.

Preparation of layer 102—$SiH_4$, $H_2$ and $B_2H_6$ gases are premixed and introduced into the deposition chamber. The ratio of $B_2H_6$ gas flow rate and $SiH_4$ gas flow rate is less than $5\times10^{-5}$ (atomic ratio).

Preparation of layer 103—$NH_3$ (or $CH_4$) and $SiH_4$ gases are premixed and introduced into the deposition chamber. The ratio of $NH_3$ (or $CH_4$)/$SiH_4$ (volume ratio) varies continuously from that of the gas composition of the transport layer 104 to zero.

Preparation of layer 104—$SiH_4$, $H_2$ and $NH_3$ (or $CH_4$) gases are premixed and introduced into the deposition chamber. The ratio of $NH_3$ (or $CH_4$)/$SiH_4$ is 3–10 (volume ratio).

EXAMPLE 1

All functional layers are deposited on Al substrate (4) which is attached to the cathode (2) in the rf plasma discharge deposition chamber.

Layer 104 is deposited by passing gases of 10 SCCM (cc/minute) $3SiH_4+2H_2$ and 50 SCCM $NH_3$ with a rf power of 60 W and a substrate temperature of 190° C. The deposition rate is 3.7 μm/hour with a deposition time of about 45 minutes.

After the deposition of layer 104, layer 103 is deposited in the same deposition parameters as layer 104, but the ratio of $NH_3$ gas flow rate and $3SiH_4+2H_2$ gas flow rate varies linearly from that of layer 104 to zero. The time of the deposition of layer 103 is about 30 minutes.

Layer 102 is deposited on layer 103 from a gas mixing of 50 SCCM $3SiH_4+2H_2$ and 10 SCCM $H_2$ diluted $B_2H_6$ (with a concentration of 100 ppm). The total gas pressure is maintained at 1.0 Torr with 60 W rf power and 190° C. substrate temperature. The deposition rate and deposition time of layer 102 are about 6 μm/hour and about 1 hour respectively.

Layer 101 is deposited on layer 102 with a gas mixing of 50 SCCM $NH_3$ and 15 SCCM $3SiH_4+2H_2$ gas flow ratio, 25 W rf power and 190° C. substrate temperature. The deposition rate and deposition time of layer 101 are about 1.7 μm/hr and 10 minutes respectirely. In the absence of layer 101, the photoreceptor will be in effect indentical.

The photoreceptor prepared on above condition possesses a surface potential larger than 600 v in 6.1 Kv positive corona discharge. The residual potential of the photoreceptor is less than 20 v. In negative discharge of 4.6 Kv, such photoreceptor posesses a surface potential larger than 700 v and residual potential less than 20 v.

EXAMPLE 2

Deposition process is same as example 1.

Layer 104 is deposited with a gas mixing of 15 SCCM $3SiH_4+2H_2$ and 50 SCCM $NH_3$ gas flow retio, 25 W rf power and 250° C. substrate tmeperature. The deposition rate is about 1.7 μm/hr with a deposition time of about 1.5 hour.

Layer 103 is deposited on layer 104 under the same condition of rf power and substrate temperature as that of layer 104, while the ratio of $NH_3$ and $3SiH_4+2H_2$ gas flow is linearly varies from that of 104 to zero. The time of the deposition needed for layer 103 is about 30 minutes.

Layer 102 is deposited on layer 103 with a gas mixing of 38 SCCM $3SiH_4+2H_2$ and 14 SCCM $H_2$ diluted $B_2H_6$ (with a concentration of 100 ppm) gas flow retio at a total gas pressure of 1 Torr, 60 W of power and 250° C. substrate temperature. The deposition rate and deposition time of layer 102 are about 4 μm/hr and 1.5 hour respectively.

Layer 101 is deposited on layer 102 in a gas mixing of 50 SCCM $NH_3$ and 15 SCCM $3SiH_4+2H_2$ gas flow ratio at 25 W rf power and 250° C. substrate temperature. The deposition rate and deposition time are about 1.7 μm/hr and 4 minutes.

The photoreceptor prepared under above condition posesses a surface potential higher than 800 V and residual potential less then 20 V under positive corona discharge of 6.1 KV. While under negative corona discharge of 4.6 KV, the surface potential of the photoreceptor is higher than 1000 V, and the residual potential is less than 6 V.

While there has been described what is at present considered to be preferred embodiment of the invention, it will be understood that various modifications may be made therein, and it is intended to cover in the appended claims all such modifications as fall within the spirit and scope of the invention.

What is claimed is:

1. A function separation type photoreceptor comprising (1) metal substrate (105), (2) a thin transport layer (104) deposited on the surface of said metal substrate (105), having large optical gap Eopt≧2.1 ev and conductivity activation energy Ea≧0.85 ev, (3) a thin intermediate gradient layer (103) deposited on the surface of said transport layer (104), wherein the ratio of N/Si or C/Si varying from that of transport layer (104) to zero, and (4) a thin photosensitive layer of a—Si:H (102) slightly doped with boron, having an optical gap Eopt=1.6–1.8 ev and conductivity activation energy Ea≧0.75 ev, deposited on the surface of said intermediate gradient layer (103).

2. The photoreceptor as set forth in claim 1, wherein further comprises a surface passivation layer or protective layer (101) deposited on the surface of said photosensitive layer (102), the thickness of said surface passivation layer or protective layer (101) fulfils the requirement of $[1-\exp(-d_{101}\alpha(\lambda))]=0.85$.

3. The photoreceptor as set forth in claim 1 or 2, wherein said metal substrate (105) is aluminium or its alloys.

4. The photoreceptor as set forth in claim 1 or 2, wherein said transport layer (104) comprises amorphous silicon alloy selected from the group consisting of a—SiNx:H and a—SiCx:H, where X, the atomic ratio of N or C to Si atom, equals to 0.4–1.3.

5. The photoreceptor as set forth in claim 1 or 2, wherein said intermediate gradient layer (103) comprises amorphous silicon-nitrogen alloy while said transport layer (104) comprises the same amorphous silicon nitrogen alloys.

6. The photoreceptor as set forth in claim 1 or 2, wherein said intermediate gradient layer (103) comprises a continuous gradient amorphours silicon-carbon alloy while said transport layer (104) comprises the same amorphous silicon-carbon alloy.

7. The photoreceptor as set forth in claim 1 or 2, wherein the thickness of said amorphous silicon photosensitive layer (102) d≧1 um.

8. The photoreceptor as set forth in claim 2, wherein said surface passivation layer or protective layer (101) comprises amorphous alloy selected from the group consisting of a—SiNx:H, a—SiCx:H, A—C:F:H and a—C:H.

9. The photoreceptor as set forth in claim 4, wherein said transport layer (104) has a thickness of d≧2 μm.

10. The photoreceptor as set forth in claim 5, wherein said intermediate gradient layer (103) has a thickness of d≧0.1 μm.

11. The photoreceptor as set forth in claim 6, wherein said intermediate gradient layer (103) has thickness of d≧0.1 μm.

12. The photoreceptor as set forth in claim 8, wherein said amorphous alloy surface passivation or pretective layer (101) has a thickness of d≧500 Å.

13. A process for fabricating the function separation type photoreceptor with an intermediate gradient layer comprises the step of that all layers of the photoreceptor are deposited on metal substrate using one of the common fabricating methods such as Plasma enhanced CVD (PECVD),
Photo-CVD,
Low pressure CVD,
Microwave plasma CVD,
Reactive sputtering,
Reactive PVD, or
Magnetron sputtering plus post hydrogenation,
wherein said
plasma enhanced CVD (PECVD) is a rf or dc plasma discharge deposition method comprising steps of attaching the metal substrate to a cathode or an anode in the plasma discharge chamber, depositing the transport layer onto said substrate in the presence of premixed gases flow of $NH_3$ (or $CH_4$), $SiH_4$ (volume ratio being 3–10, depositing the intermediate gradient layer onto said transport layer in the presence of premixed gases flow of $NH_3$ (or $CH_4$) and $H_2$, with a ratio of $NH_3$ (or $CH_4$)/$SiH_4$ (gas flow volume ratio) being varied from 3–10 of said transport layer to zero, and depositing the photosensitive layer onto said gradient layer in the presence of premixed gases flow of $SiH_4$, $H_2$ and $B_2H_6$, with the ratio of $B_2H_6/SiH_4$ (atom number ratio) being less than $5\times10^{-5}$.

14. The process as set forth in claim 13, wherein further comprises the step of depositing the surface passivation layer or protective layer (101) onto said photosensitive layer (102) in the presence of pre-mixed gases flow of $SiH_4$, $H_2$ and $NH_3$ (or $CH_4$), $CF_4$ with the ratio of $NH_3$ (or $CH_4$)/$SiH_4$ (volume ratio) being 5–7.

15. The process as set forth in claim 13 or 14, wherein said substrate (105) is maintained in the temperature range of 190°–250° C.

* * * * *